United States Patent [19]

Armstrong et al.

[11] 4,189,044

[45] Feb. 19, 1980

[54] COAT HANGER VENDING MACHINE

[75] Inventors: Currie Armstrong, 255 W. Torrance Blvd., Carson, Calif. 90745; Clarence E. Christophersen, San Clemente, Calif.

[73] Assignee: Currie Armstrong, Los Angeles, Calif.

[21] Appl. No.: 942,360

[22] Filed: Sep. 14, 1978

[51] Int. Cl.[2] ..... G07F 11/40

[52] U.S. Cl. ..... 194/2; 221/19; 221/232; 221/312 A

[58] Field of Search ..... 221/17–20, 221/151, 152, 232, 268, 312 R, 312 A; 194/2

[56] References Cited

U.S. PATENT DOCUMENTS

| | | | |
|---|---|---|---|
| 3,055,547 | 9/1962 | Radcliffe et al. | 221/232 |
| 3,095,958 | 7/1963 | Whitman | 221/312 R |
| 3,103,298 | 9/1963 | Polster | 221/312 R X |
| 3,110,415 | 11/1963 | Robbins et al. | 221/312 A |

*Primary Examiner*—Joseph J. Rolla
*Attorney, Agent, or Firm*—Georges A. Maxwell

[57] ABSTRACT

A clothes hanger vending machine comprising a box-like cabinet, a horizontal clothes hanger supporting rod within the cabinet with a free end spaced from a wall in the cabinet a distance sufficient to permit the downward movement of the hook portion of one clothes hanger therebetween; a spring loaded stop normally bridging the space between the free end of the rod and said wall; a spring loaded follower shiftably carried by the rod and normally yieldingly urging a row of hangers hooked over the rod toward the free end thereof and the first hanger of said row of hangers into said space and onto engagement with said stop; a vertically shiftable ejector normally above said space and said first hanger; and, a coin released manually-operable actuating member intermittently operable to move the ejector downwardly and to urge said first hanger downwardly by the stop and through and from said space for free manual engagement and extraction from the machine.

9 Claims, 7 Drawing Figures

11
12
41
E
42
40
38
36
35
37
6
67
60
61
63
O
73
31
33
45
43
65
66
S
71
L
72
20
X
68
64
62
70
32
51'
51
F
R
M
34
30
10
44
21
22
H'

COAT HANGER VENDING MACHINE

This invention has to do with vending machines and is particularly concerned with a novel clothes hanger vending machine.

The machine of the present invention is adapted to dispense that most common and well-known class of clothes hangers which comprise triangular frames with horizontal bases, upwardly and laterally inwardly convergent sides, converging at acute angle to the bases and establishing apexes at obtuse angles, and substantially downwardly opening clothes pole engaging hook portions projecting upwardly from the apexes of the frames. Such clothes hangers are commonly made of steel wire or of a suitable plastic resin.

In recent years, plastic clothes hangers of the general character here concerned with have been embellished with desirable design characteristics and have been provided with special features such as negligee strap receiving recesses or notches in their sides. These noted special features extend or increase the usefulness of such hangers. Accordingly, plastic clothes hangers of the character referred to above, though slightly more costly than wire clothes hangers, are most desirable. As a result of the foregoing, the machine that we provide will be shown and described as working upon plastic clothes hangers, though in practice, it can be made and/or adjusted to effectively work upon and to dispense wire clothes hangers.

In considering the handling of and working with a plurality of clothes hangers of the character referred to above, as for the purpose of dispensing them one at a time, it is to be particularly noted that such hangers are generally provided or supplied in a rather loose assembly and are such that they readily shift and move relative to each other in such a manner that they hook and interengage with each other to establish what can best be described as a "tangled mess". The tendency of adjacent clothes hangers to interengage, hook and become tangled together has been the major obstacle confronted by the prior art in attempts to provide satisfactory vending machines capable of dependably dispensing clothes hangers one at a time.

Those machines provided by the prior art for vending or otherwise working upon or handling clothes hangers and which have held promise for attaining their intended function have included special clothes hanger carrier and/or transporting means for receiving and transporting hangers in separate or separated condition. Such hanger carrier and/or transporting means have proven to be so complicated and costly to make that their adoption and use in vending machines has proven to be impractical. Further, such carrier and/or transporting means have, as a general rule, been such that it is extremely difficult and inconvenient to load them, that is, to engage and relate a supply of clothes hangers on/or with them; and they require an excessive amount of space in ratio to the number of hangers they can effectively handle and/or work upon for practical use in vending machines.

An object of our invention is to provide a clothes hanger vending machine which is extremely simple and economical to make; a machine which is highly effective and dependable to dispense related clothes hangers one at a time; a machine which is easy and convenient to service and load; and, a machine which is small and compact wlith respect to the number of hangers it is capable of handling and/or working upon.

It is an object and feature of our invention to provide a machine of the general character referred to above which includes a box-like cabinet, a horizontal clothes hanger supporting rod within the cabinet with a free end spaced from a wall in the cabinet a distance sufficient to permit the downward movement of the hook portion of one clothes hanger therebetween; a spring loaded stop normally bridging the space between the free end of the rod and said wall; a spring loaded follower shiftaably carried by the rod and normally yieldingly urging a row of hangers hooked over the rod toward the free end thereof and the first hanger of said row of hangers into said space and onto engagement with said stop; a vertically shiftable ejector normally above said space and said first hanger; and, coin released manually operable actating means intermittently operable to move the ejector means downwardly and to urge said first hanger downwardly by the stop and through and from said space for free manual engagement and extraction from the machine.

It is another object and feature of our invention to provide a machine of the general character referred to above wherein the cabinet has an access opening at its top to provide easy access to the rod and follower and which is normally closed by a key locked cover and a machine wherein the cabinet has a manually accessible discharge opening in its lower portion below the rod and the hangers on the rod and a baffle structure between the opening and said rod and hangers to make the hangers on the rod inaccessible through said discharge opening.

Yet another object and feature of our invention is to provide a structure of the general character referred to above wherein the ejector is an elongate blade or bar-like part with one end shiftable through said space at the free end of the rod and its other end pivotally mounted within the cabinet at a location rearward from said rod and space, whereby said one end of the ejector bar can be shifted downwardly into and through said space to engage and move a hanger adjacent said space and engaged on said stop, by said stop and through said space.

Another object and feature of our invention is to provide a machine of the character referred to above wherein the ejector bar has wedge means to engage the second hanger on the rod occurring next to said first hanger and to hold and/or urge said second hanger on the rod away from said space when the ejector is moved to advance said first hanger through said space.

Still another object and feature of our invention is to provide a machine of the general character referred to above wherein said operating means includes a manually operable coin release mechanism accessible at the exterior of the cabinet and having an elongate axially shiftable drive member within the cabinet, a bell crank pivotally mounted in the cabinet with one arm pivotally connected with the ejector bar and its other arm engageable with the drive member whereby said mechanism is operable to rotate said crank and said crank is operable to pivot the ejector bar to advance said first hanger by said stop and through said space.

Finally, it is an object and feature of our invention to provide novel locking means which operates to lock the operating means and prevent its acceptance of coins and its operation when the supply of hangers in the machine has been exhausted.

The foregoing and other objects and features of our invention will be fully understood from the following detailed description of one typical preferred form and carrying out of our invention throughout which description reference is made to the accompanying drawings.

DETAILED DESCRIPTION OF THE INVENTION

Figure 1:
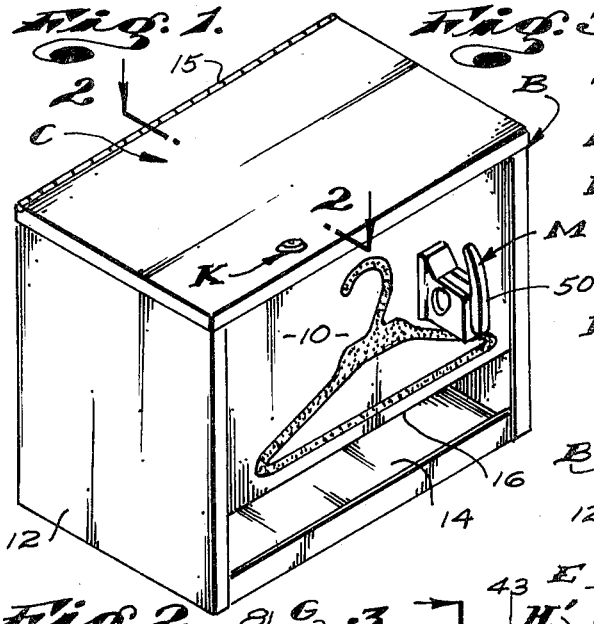
FIG. 1 is an isometric view of our machine.
Figure 3:
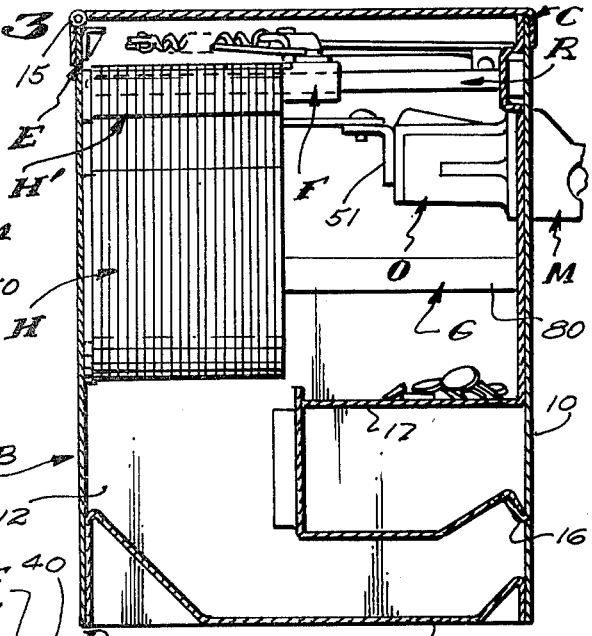
FIG. 3 is a sectional view taken as indicated by line 3—3 on FIG. 2.
Figure 2:
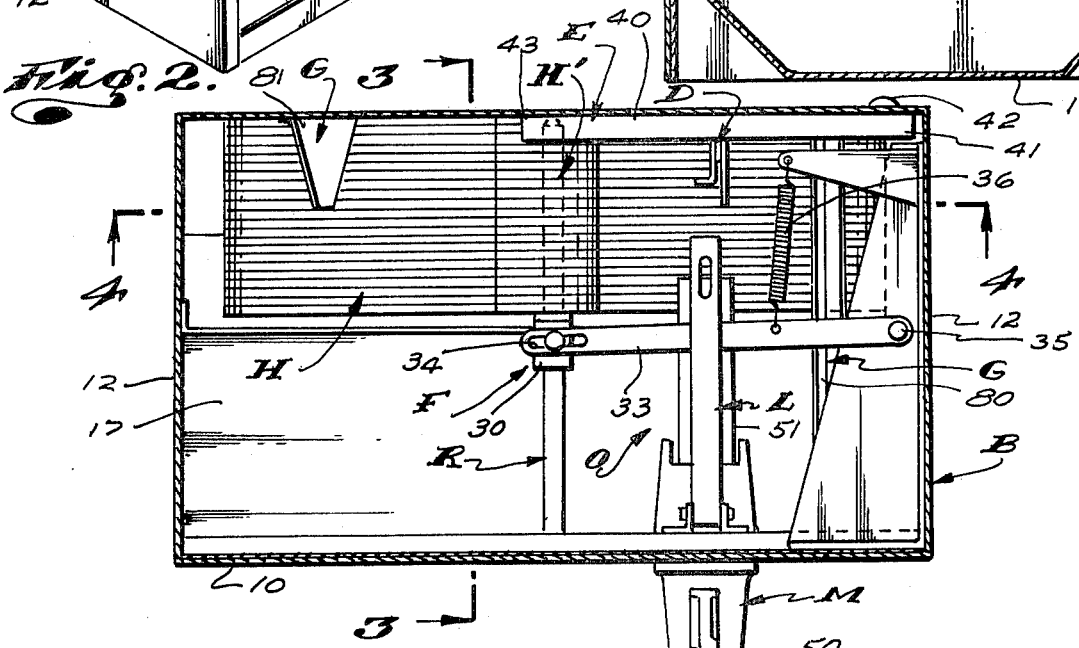
FIG. 2 is an enlarged sectional view taken substantially as indicated by line 2—2 on FIG. 1.
Figure 4:
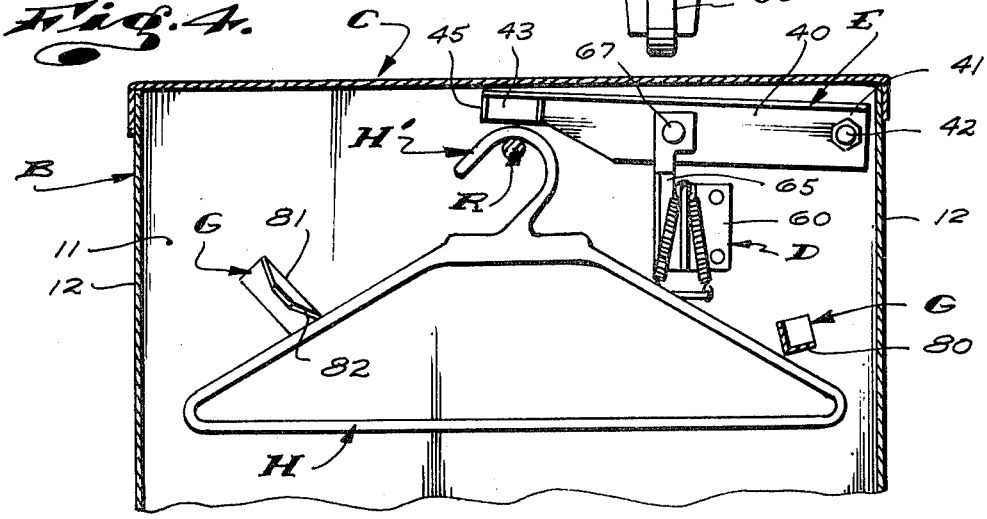
FIG. 4 is a sectional view taken substantially as indicated by line 4—4 on FIG. 2.

Referring to the drawings, the machine A that we provide includes a simple box-like cabinet B formed of sheet metal and having front, rear, side and bottom walls 10, 11, 12 and 14 and an open top. The open top is normally closed by a cover C hinged to the rear wall as at 15. In practice, the cover C is releasably secured in closed relationship with the cabinet by a suitable key lock mechanism K.

The lower portion of the front wall 10 has an elongate laterally extending discharge opening 16 providing manual access to the lower interior of the cabinet adjacent the top surface of the bottom wall 14 and to clothes hanger H advanced downwardly in the cabinet and forwardly into supported engagement on the bottom wall thereof.

The bottom wall 14 is provided with front and rear inclined ramp portions to direct and suitably control the movement of hangers in and through the lower portion of the cabinet.

In addition to the above, the front wall 10 of the cabinet has a suitably rearwardly projecting laterally extending baffle structure 17 occurring in vertical spaced relationship above the forward portion of the bottom wall 14. The baffle 17 prevents manual access to the upper portion of the cabinet and to hangers therein, through the discharge opening 16. The baffle 17 also establishes an upwardly disposed coin receiving tray onto which coins, fed into the machine are dsposited for subsequent collection.

Figures 5, 6, 7:
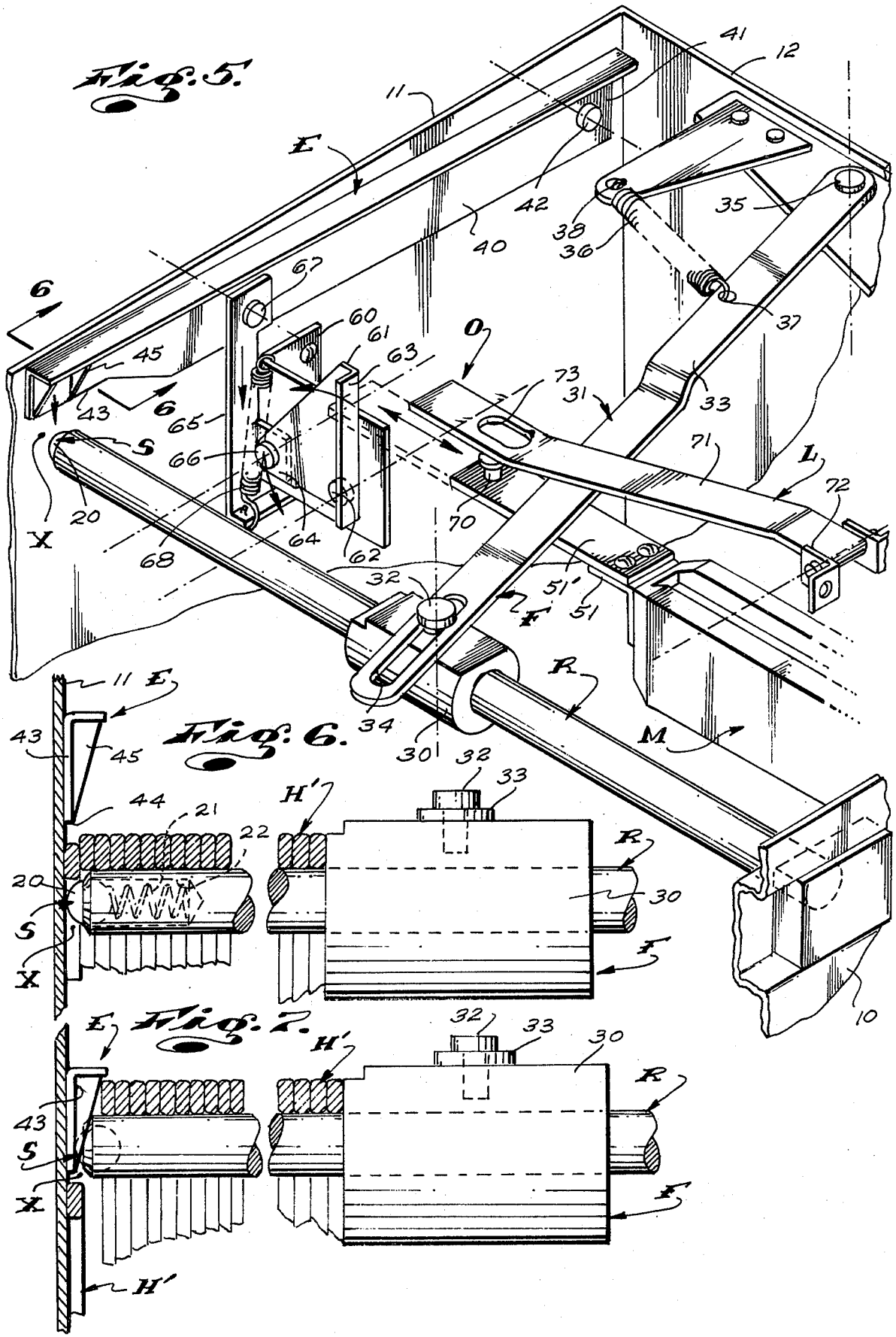
FIG. 5 is an isometric view of a portion of our machine.
FIG. 6 is an enlarged detailed sectional view taken substantially as indicated by line 6—6 on FIG. 5.
FIG. 7 is an isometric view similar to FIG. 6 showing parts in other positions.

The machine A that we provide next includes an elongate, horizontal, support rod R with front and rear ends. The rod R extends fore and aft within the upper portion of the cabinet, above the baffle 17 and below the open top of the cabinet and the cover C. The rod R is located substantially intermediate the side walls 12 of the cabinet. The support rod is cantilever supported in the cabinet B with its front end securely mounted to the inside surface of the front wall 10. The rear or free end of the rod is in predetermined spaced relationship from the inside surface of the rear wall 11, as shown in FIG. 6 of the drawings. The rear end of the rod and rear wall cooperate to define a space X of predetermined limited extent through which the upper hook portion H' of clothes hangers H can move or pass one at a time.

In practice, the rod R is about 11" long and such that it can, for example, effectively carry and support about 50'185" thick plastic clothes hangers H, arranged in side by side relationship and with their upper hook portions H' engaged over and about the rod.

The machine A next includes releasable stop means S normally bridging the space X between the wall 11 and rod R. In the case illustrated, the stop means S includes a spring loaded ball 20 carried by the rod R. The ball 20 is greater in radial extent than the space X. The ball is engaged in the rear end of a bore 21 entering the rear end of the rod R and is normally yieldingly urged rearwardly to bridge the space X and to engage the wall 11 by a spring 22 within the bore, forward of the ball.

The stop means S is such that the ball normally engages and stops downward movement of the hook portion of a hanger above and entering the space X and will, upon downward urging of that hanger, yieldingly move forwardly into the bore 21 and allow for the free downward movement of the hanger through and from the space X.

The machine A next includes follower means F to normally yieldingly urge and move a supply or row of hanger H supported by the rod R, rearwardly on the rod and to move the rearmost or first hanger rearwardly into stopped engagement with the inside surface of the rear wall 11, above the space X, as shown in FIG. 6 of the drawings.

The means F includes a follower block 30 slidably engaged on and shiftable longitudinally of the rod and spring loaded advancing means 31 normally yieldingly urging the block rearwardly. The means 31 is shown as including a drive pin 32 on the block 30, an elongate link 33 with a slot 34 in one end and pivotally and slidably receiving the pin 32 and has its other end pivotally mounted in the cabinet in lateral spaced relationship from the rod, as shown at 35 in FIG. 5 of the drawings.

Finally, the means 31 includes an elongate tension spring 36 with one end engaged with the link 33, between the ends thereof, as at 37 and its other end suitably anchored within the cabinet, rearward of the link, as shown at 38 in FIG. 5 of the drawings.

The block 30 is manually shiftable and is, upon loading the machine with a supply of hangers H, moved forwardly against the resistance of the spring 36 so it engages the hook portion H' of the last or foremost hanger engaged on the rod R. Thereafter, the means F is released from manual engagement and operates to urge the supply of hangers rearwardly, as required and as noted above.

The machine A next includes ejector means E operable to engage the top of the hook portion H' of the first or rearmost hanger H occurring at the space X and supported by the stop means S. The ejector means E operates to urge the said first hanger downwardly by the stop means S and through and from the space X. The hanger thus worked upon is free to drop downwardly into engagement on the bottom wall 14 of the cabinet where it is freely accessible through the forward discharge opening 16 in the cabinet.

The means E includes an elongate horizontal ejector arm 40 with an outer end 41 pivotally mounted within the cabinet, as at 42, in lateral spaced relationship from the free end of the bar. The arm 40 has a flat vertical blade-like inner end portion 43 with a substantially horizontal laterally extending lower edge 44. The end portion 43 occurs in flat opposing and preferably sliding engagement with the inner surface of the rear wall 11 and in spaced relationship above the hook portion H of said first hanger H which is in flat supported engagement on the rear wall 11, at the space X, above the stop means S.

In practice, and in the preferred carrying out of our invention, the free end portion 43 of the ejector arm carries a pair of laterally spaced forwardly and upwardly inclined wedges 45 which move downwardly to occur at opposite sides of the rear end portion of the rod R and the stop means S when the arm is operated to eject the noted first hanger H. The wedges 45 wedge between the arm or rear wall 11 and the second or next hanger H on the rod and prevent that hanger from advancing forwardly into interfering relationship with the arm as the first hanger is being worked upon thereby.

In practice, the wedges might move the second hanger and the remaining supply of hangers on the rod forwardly a short distance when acting upon said second hanger, as shown in FIGS. 6 and 7 of the drawings. Such movement or working of the hangers H on the rod appears to assist movement and setting of the hangers in proper alignment and disposition on the rod.

The machine A next includes manual operating means O operable to normally maintain a free end portion 43 of the arm 40 in a normal up position and to selectively move that arm downwardly to an actuated position.

The means O shown in the drawings includes a manually operable vending machine coin mechanism N. The mechanisn N can be selected from the numerous commercially available manually operable vending machine coin mechanisms and preferably includes a manually engageable operating drive member 50, a shiftable driven member 51 and coin receiving means which normally locks and prevents operation or movement of the driven member and which, upon engagement of a coin or coins therein, allows or permits shifting of said driven member in response to manual operation or shifting of the drive member.

The means O next includes drive means D connected with and between the arm 40 of the means E and the driven member 51 of the means M. The means O can vary widely in form. The form which the means O takes is dictated, in large part, by the relative location and dispositioning of the coin mechanism N and the ejector means E.

In the particular case illustrated, the coin mechanism is mounted on and extends through the front wall 10 of the cabinet B with the drive member 50 accessible at the front of the wall 10 and with the driven member 51 at the rear of the wall 10 and shiftable forwardly and rearwardly within the cabinet. The operating means O includes an elongated 52 on the member 51, projecting rearwardly therefrom and having a free rear end spaced a predetermined distance forward of the rear wall 11. The extension 52 is in fact a mere continuation of the member 51 of the machine N and will hereinafter be referred to as the drive member.

The means O next includes a forwardly projecting bracket 60 fixed to the inside of the rear wall 11, rearward of the drive member 51 and below the arm 40 of the means E. A bell crank 61 is pivotally carried on the bracket 60 at a point spaced forward of the wall 11 and below the horizontal plane of the driven member 51, as shown at 63 in FIG. 5 of the drawings. The crank 61 has a forward, normally vertical, upwardly projecting driven arm 63, the upper end of which occurs in the path of the member 51 and is engageable with the rear end of the member 51 upon rearward movement of that member. The crank next includes a lower, normally horizontal, rearwardly projecting drive arm 64. The means O next includes an elongate vertical connector bar 65 with a lower end pivotally connected with the rear end of the arm 64, as at 66, and an upper end pivotally connected with the ejector arm 40 of the means E, intermediate the ends of the arm 40, as shown at 67.

Finally, the means O includes a spring 68 between the bracket 60 and connector bar 65 to normally yieldingly urge and hold the bar and the arm 40 up, in a normal position where the free end portion 43 of the arm 40 occurs in spaced relationship above the first hanger H at the space X.

It will be apparent that upon manual operation of the drive member 50 and rearward shifting of the driven member 51 of the mechanism N, the member 51 engages and pivots the arm 63 rearwardly and the arm 64 downwardly. Downward pivoting of the arm 64 draws the bar 65 and the ejector arm 40 downwardly to effect engagement of the arm 40 with the first hanger H and movement of that hanger H downwardly past the stop means S and from the space X, as noted in the foregoing.

It is to be noted that by appropriate proportioning of the bell crank 60, the motion afforded by the mechanism N and/or a mechanical advantage is attained which affords dependable, easy and convenient operation of the mechanism.

Finally, the machine A is provided with locking means L to lock and prevent operation of the mechanism N when the supply of hangers H on the rod R has been exhausted. The means L includes a lock pin 70 projecting upwardly from the rear end portion of the driven member 51 and an elongate lock arm 71. The lock arm has a front end pivotally mounted to the front wall 10 as at 72. The front end of the arm 71 is mounted above the mechanism N. The arm 71 projects rearwardly from the front wall into sliding supported engagement over and above the top of the arm 33 of the follower means F, which arm 33 occurs above and normally extends across the member 51 of the mechanism N is spaced relationship therefrom, as clearly illustrated in the drawings.

The front end of the arm 71 has a vertical through opening or slot 73 to accommodate the pin 70.

The arm 71 is of limited predetermined longitudinal extent and is such that when the supply of hangers on the bar is exhausted and the block 30 of the follower means F is moved rearwardly into stopped engagement with the rear wall 11 of the cabinet, the advancing arm 33 of the means F pivots and is moved rearwardly out of engagement from below the rear end of the stop arm 71 and the stop arm 71 pivots and drops downwardly to engage the top of the member 51, with the pin 70 projecting upwardly through the opening 73. With the pin 70 engaged in the opening 73 in the arm 71, it will be apparent that the mechanism M is effectively locked and cannot be operated until the arm 71 is manually lifted out of engagement with the member 51, the block 30 and the arm 33 are moved forwardly, a new supply of hangers H is engaged with the bar B, rearward of the block 30 and the bar 31 is lowered and again engaged and supported atop the arm 33.

Finally, the machine of the present invention includes guide means G to normally maintain the lower portions of the hangers H engaged on the rod R in proper alignment; that is, with their bases horizontal and with the bases and sides or adjacent hangers in substantial parallel relationship with each other.

The means G first includes an elongate horizontal guide beam 80 fixed to and extending between the front and rear walls 10 and 11 of the cabinet to occur above and slidably engage one side of the frame portions of the hangers supported on the rod R, at the lateral outer end portions thereof. The beam 80 is arranged within the cabinet B at the same side of the rod and hangers H as are the means D and O of the machine.

The means G next includes an elongate guide plate 81 at the other side of the cabinet B to engage the upper edges of the other sides of the lower frame portions of the hangers H on the rod R. The plate 81 is fixed to and projects forwardly from the rear wall 11 and has a forwardly and upwardly inclined lower hanger engaging edge 82. The plate is of limited longitudinal extent and such that it overlies a limited number of the rearmost hangers on the rod. The lower edge 82 of the plate 81 is so inclined that it freely accommodates the sides of the hangers related to it as those hangers advance rearwardly and is such that it guides those hangers into precise predetermined disposition as they are advanced toward the rear wall 11.

The guide plate 81 is short and is only related to the rearmost hangers H on the rod in order to facilitate easy and convenient loading of the machine with hangers.

It will be apparent that if the guide plate 81 extended fore and aft between the front and rear walls 10 and 11 as does the beam 80, it would prevent the engagement of hangers on the rod. By limiting the extent of the plate 81, the side of the cabinet within which the plate 81 is related is unobstructed forward of the plate 81 and freely permits the insertion of hangers into the cabinet and into hook engagement with the rod R.

In practice, the rear end of the rod 80 and the rear end of the edge 82 of the plate 81 can be provided with forwardly disposed primary stop shoulders (not shown) to engage and releasably stop their adjacent portions of the second hanger on the rod in limited forward spaced relationship from the lower portion of the first hanger. By maintaining the lower portions of the first and second hanger spaced, the second hanger cannot interfere with or impede downward movement or free dropping of the first hanger.

It is to be noted that the hangers H disengaged from the rod R and the stop means S by the ejector means E drop downwardly in the rear portion of the cabinet behind the baffle structure 17 and are deflected and directed forwardly onto and across the bottom wall 14 of the cabinet below the baffle structure 17 into close proximity to the discharge opening 16 in the front wall 10 of the cabinet. Hangers H deposited on the bottom wall 14 of the cabinet in the manner set forth above are readily visible through the access opening 16 and can be easily and conveniently manually engaged and removed from the cabinet, through the opening 16 by the purchasers thereof.

For the purpose of more briefly and succinctly claiming our invention, the following structural characteristics of the machine are to be noted.

The back wall 11 of the cabinet B is a part of the operating means of the machine. The wall 11 establishes a flat vertical forwardly disposed stop surface which cooperates with the rod R to define the space X, against which the ball 20 of the stop means normally stops and against which the rearwardly advancing hangers H are yieldingly held, one at a time. Further, the wall 11 defines that surface relative to which the free end portion of the ejector arm moves and downwardly and across which the hangers are advanced when being discharged. In practice, utilitarian functions of the wall 11 can be performed by a separate plate mounted within the cabinet, without departing from the spirit of our invention.

Further, the partition structure 17 within the lower portion of the cabinet B is spaced forward from the rear wall 11 and vertically above the bottom wall 14 and cooperates therewith to define a downwardly and forwardly extending discharge passage between the upper portion of the cabinet, at the rear thereof and the discharge opening 16 in the lower front thereof.

Having described only one typical preferred form and carrying out of our invention, we do not with to be limited to the specific details herein set forth, but wish to reserve to ourselves any modifications and/or variations that may appear to those skilled in the art and which fall within the scope of the following claims:

Having described our invention, we claim:

1. A clothes hanger vending machine comprising a cabinet having substantially flat, vertical, front rear and side walls and substantially horizontal top and bottom walls, said front wall having a discharge opening in its lower portion, a partition within the lower portion of the cabinet defining a clothes hanger discharge passage communicating with the upper portion of the cabinet and the discharge opening, structure in the upper portion of the cabinet defining a flat, vertical, forwardly disposed rear surface above said discharge passage, an elongate substantially horizontal clothes hanger supporting rod within the upper portion of the cabinet having a forward end securely mounted in the forward portion of the cabinet and a free end in spaced relationship from said surface to define a space through which clothes hangers can move, one at a time, a supply of clothes hangers with lower frame portions and with upper downwardly opening hook portions engaged over the rod, spring loaded stop means within and normally bridging said space to engage and releasably support the hook portion of a hanger in said space, follower means including a follower block slidably engaged on the rod foward of the hangers engaged thereon and spring means normally yieldingly urging the block and said hangers longitudinally rearwardly on the rod and the rearmost hanger on said rod against said surface and to said space, ejector means including a hanger engaging ejector blade normally adjacent said surface above said space and said first hanger and operating means to selectively move the blade downwardly to engage and advance said first hanger past said stop means and through said space for free movement into and through said passage, operating means for the ejector blade including a manually operable coin mechanism mounted on and extending through a wall of the cabinet and having a manually movable drive member at the exterior of the case and a movable driven member within the cabinet and movable in response to movement of the drive member, and link and lever means between said blade and said driven member whereby said blade is moved downwardly and upwardly in response to movement of the driven member.

2. The machine set forth in claim 1 wherein the lower frame portions of the hangers have laterally extending horizontal lower bases and laterally inwardly and upwardly inclined sides; said machine includes guide means to guide and maintain the hangers in predetermined disposition within the cabinet; said guide means includes an elongate guide beam in the cabinet in lateral spaced parallel relationship with the rod to occur above and slidably engage the sides of the hangers at one side of the rod and a forwardly projecting guide of limited longitudinal extent projecting forwardly from the rear surface to occur above and slidably engage the other sides of the hangers engaged with and supported by the rear end portion of the rod.

3. The machine set forth in claim 1 which further includes guide means to guide and maintain the hangers in proper disposition on the rod, said guide means includes elongate guide parts projecting forwardly from said surface to occur above and engage the frame portions of the hanger.

4. The machine set forth in claim 1 which further includes lock means to lock the coin mechanism when the supply of hangers on the rod is exhausted; said lock means includes a vertical lock pin on the movable drive member, an elongate lock arm with one end pivotally mounted within the cabinet remote from the drive member and projecting in the cabinet above said drive member and in sliding supported engagement with parts of the follower means when the block of the follower means is spaced forward of the rear surface and is disengaged by the parts of the follower means and is free to pivot downwardly when the block moves rearwardly into engagement with said rear surface; said lock arm has an opening through which the pivot pin projects when the arm is disengaged by the follower means and pivots down and engages the drive member.

5. The machine set forth in claim 4 wherein the lower frame portions of the hangers have laterally extending horizontal lower bases and laterally inwardly and upwardly inclined sides; said machine includes guide means to guide and maintain the hangers in prdetermined disposition within the cabinet; said guide means includes an elongate guide beam in the cabinet in lateral spaced parallel relationship with the rod to occur above and slidably engage the sides of the hangers at one side of the rod and a forwardly projecting guide of limited longitudinal extent projecting forwardly from the rear surface to occur above and slidably engage the other sides of the hangers engaged with and supported by the rear end portion of the rod.

6. The machine set forth in claim 1 wherein said rear surface is established by the rear wall of the cabinet, said rod is mounted on the front wall of the cabinet, said coin mechanism is mounted on and extends through the front wall of the cabinet; said driven member moves back and forth within the cabinet; and, said link and lever means includes a bell crank pivotally mounted in the rear portion of the cabinet with one arm normally projecting upwardly and engaged and moved rearwardly by the driven member when said driven member moves rearwardly and another arm normally projecting horizontally and rearwardly below the blade and shiftable downwardly when said one arm is moved rearwardly and a drive link between said other arm and said ejector blade whereby said blade is moved downwardly with said other arm.

7. The machine set forth in claim 6 which further includes lock means to lock the coin mechanism when the supply of hangers on the rod is exhausted; said lock means includes a vertical lock pin on the movable drive member, an elongate lock arm with one end pivotally mounted within the cabinet remote from the drive member and projecting in the cabinet above said drive member and in sliding supported engagement with parts of the follower means when the block of the follower means is spaced forward of the rear surface and is disengaged by the parts of the follower means and is free to pivot downwardly when the block moves rearwardly into engagement with said rear surface, said lock arm has an opening through which the pivot pin projects when the arm is disengaged by the follower means and pivots down and engages the drive member.

8. The machine set forth in claim 6 wherein the lower frame portions of the hangers have laterally extending horizontal lower bases and laterally inwardly and upwardly inclined sides; said machine includes guide means to guide and mainatin the hangers in predetermined disposition within the cabinet; said guide means includes an elongate guide beam in the cabinetin lateral spaced parallel relationship with the rod to occur above and slidably engage the sides of the hangers at one side of the rod and a forwardly projecting guide of limited longitudinal extent projecting forwardly from the rear surface to occur above and slidably engage the other sides of the hangers engaged with and supported by the rear end portion of the rod.

9. The machine set forth in claim 8 which further includes a lock means to lock the coin mechanism when the supply of hangers on the rod is exhausted; said lock means includes a vertical lock pin on the movable drive member, an elongate lock arm with one end pivotally mounted within the cabinet remote from the drive member and projecting in the cabinet above said drive member and in sliding supported engagement with parts of the follower means when the block of the followere means is spaced forward of the rear surface and is disengaged by the parts of the follower means and is free to pivot downwardly when the block moves rearwardly into engagement with said rear surface, said lock arm has an opening through which the pivot pin projects when the arm is disengaged by the follower means and pivots down and engages the drive member.

* * * * *